United States Patent [19]

Zammuto

[11] Patent Number: 4,561,660

[45] Date of Patent: Dec. 31, 1985

[54] DART MACHINE WITH ELECTRONIC MATRIX

[75] Inventor: Samuel N. Zammuto, Rockford, Ill.

[73] Assignee: Arachnid, Inc., Rockford, Ill.

[21] Appl. No.: 551,018

[22] Filed: Nov. 14, 1983

[51] Int. Cl.[4] ..... A63B 65/02

[52] U.S. Cl. ..... 273/376

[58] Field of Search ..... 273/371, 373, 374, 376, 273/377; 340/323 R

[56] References Cited

U.S. PATENT DOCUMENTS

| | | | |
|---|---|---|---|
| 346,876 | 8/1886 | Ullman . | |
| 1,096,292 | 5/1914 | Ellis . | |
| 1,306,048 | 6/1919 | Coy . | |
| 1,402,523 | 1/1922 | Michoud . | |
| 2,487,871 | 11/1949 | Havey | 273/102.2 |
| 2,592,429 | 4/1952 | Kimmel et al. | 273/102.2 |
| 2,629,599 | 2/1953 | Gaut | 273/102.2 |
| 2,695,173 | 11/1954 | Sterne | 273/102.2 |
| 3,454,276 | 7/1969 | Brenkert et al. | 273/102.2 |
| 3,729,197 | 4/1973 | Swanson et al. | 273/102.2 R |
| 3,805,030 | 4/1974 | Wichinsky et al. | 235/92 |
| 3,972,531 | 8/1976 | Knapp | 273/102.2 R |
| 4,057,251 | 11/1977 | Jones et al. | 273/376 |
| 4,365,805 | 12/1982 | Levine | 340/323 R |

FOREIGN PATENT DOCUMENTS 474718 12/1913 France .

OTHER PUBLICATIONS

British Aircraft Corp. Ltd., "Project 'ARACHNID' Report on the Pre-University Course Project," Dec. 1973.

*Primary Examiner*—Richard C. Pinkham
*Assistant Examiner*—Vincent A. Mosconi
*Attorney, Agent, or Firm*—Leydig, Voit & Mayer

[57] ABSTRACT

A dart game for use with "safe" darts has enhanced electronic scorekeeping reliability. The dart game has a target including target sections for receiving thrown safe darts, the target sections being slidably mounted in a spider target frame. The spider and target sections are mounted in front of a pressure sensitive switch matrix for electronic sensing of dart hits. An apertured sheet of resilient material placed between the target sections and the switch matrix creates a gap through which an impacted target section must be displaced before it can compress and close an associated switch in the switch matrix, thereby enhancing the continuity and prolonging the duration of the switch contact. Ridges on the target section sides ensure ease of motion of the target section in the spider target frame.

20 Claims, 11 Drawing Figures

DART MACHINE WITH ELECTRONIC MATRIX

FIELD OF THE INVENTION

This invention relates generally to electronic games, and more particularly to dart games which automatically register the score attained by the players.

BACKGROUND OF THE INVENTION

It is usual in the field of electronic dart games to provide the dart board or target with sections or cups which are responsive to "safe" darts, the sections or cups being slidably mounted in a spider frame. The spider and target sections are mounted in front of a pressure sensitive switch matrix. The switch matrix has at least one switch associated with each target section. The impact force of a thrown dart displaces the respective section inward thereby closing the associated switch to signal a dart hit.

The prior art uses resilient devices to bias the target section in an initial forward position and to cushion the impact of the section with the associated switch. These resilient devices, in the form of diaphragms, bellows-like buttons, and solid rubber sheets, while adequate for biasing the section in the proper position, do not allow for maximum reliability in scoring.

The prior art is exemplified by the dart game shown in U.S. Pat. No. 4,057,251 [Jones et al.] herein incorporated by reference. A game similar to that disclosed in Jones et al. has been manufactured with target cups having feet resting on a solid rubber damper sheet interposed between the target cups and a matrix switch of imprinted Mylar sheets.

SUMMARY OF THE INVENTION

The primary object of the present invention is to provide an electronic dart game with highly reliable scorekeeping capability. In large, the foregoing is achieved by providing the board with a damper sheet located between a resilient biasing sheet and a pressure sensitive switch matrix. This damper creates a gap through which an impacted target section must be displaced before it can compress the switch matrix and close an electrical contact. The resultant gap adds cushioning to the impact area so that immediate rebound is reduced and the electrical contact is momentarily delayed, thereby ensuring that the dart is firmly implanted in the target section at the time of switch impact. Accordingly, enhanced momentum transfer occurs, thus ensuring an electrical contact of greater duration and continuity. This improves the game's automatic scorekeeping reliability.

This same object is further achieved by providing each target section with guides in the form of ridges on the outside of the target section. As a result of these guides, binding and the possibility of jamming between the target section and spider frame is reduced because the area of surface contact between the section and the frame is greatly reduced. An accumulation of dust in the interface between the section and spider frame, for example, is less likely to cause the section to stick rather than slide smoothly inward upon impact of a dart with the section.

BRIEF DESCRIPTION OF THE DRAWINGS

Other objects and advantages of the invention will become apparent from the following detailed description and the accompanying drawings, in which.

While the invention will be described in connection with certain preferred embodiments, it will be understood that it is not intended to limit the invention to those particular embodiments. On the contrary, it is intended to cover all alternatives, modifications and equivalents as may be included within the spirit and scope of the invention as defined by the appended claims.

DETAILED DESCRIPTION OF THE PREFERRED EMBODIMENT

Figure 1:
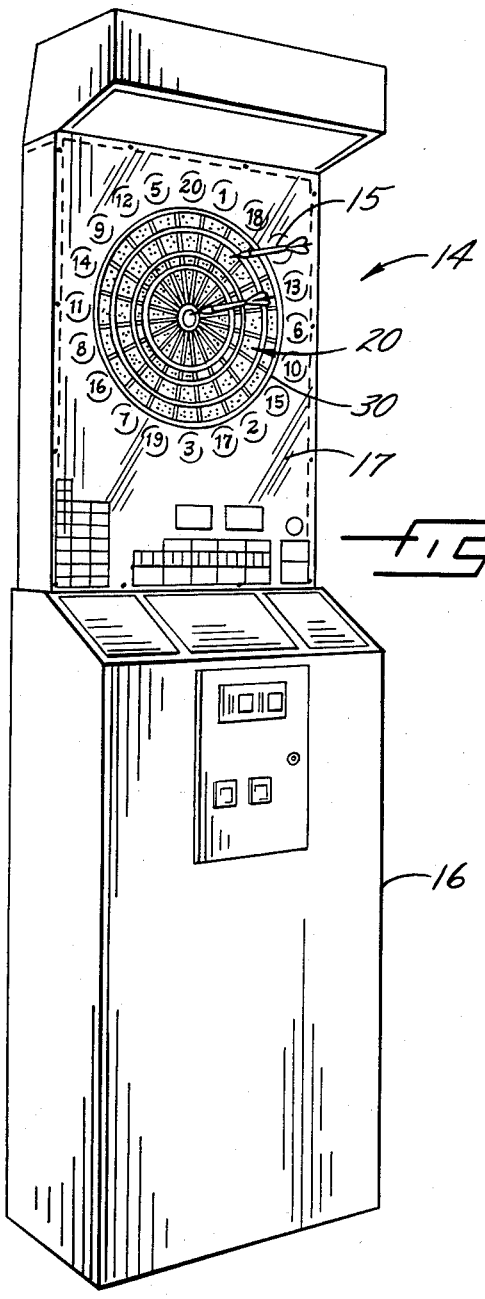
FIG. 1 is a perspective view of an electronic dart game machine incorporating the invention.
Figure 3:
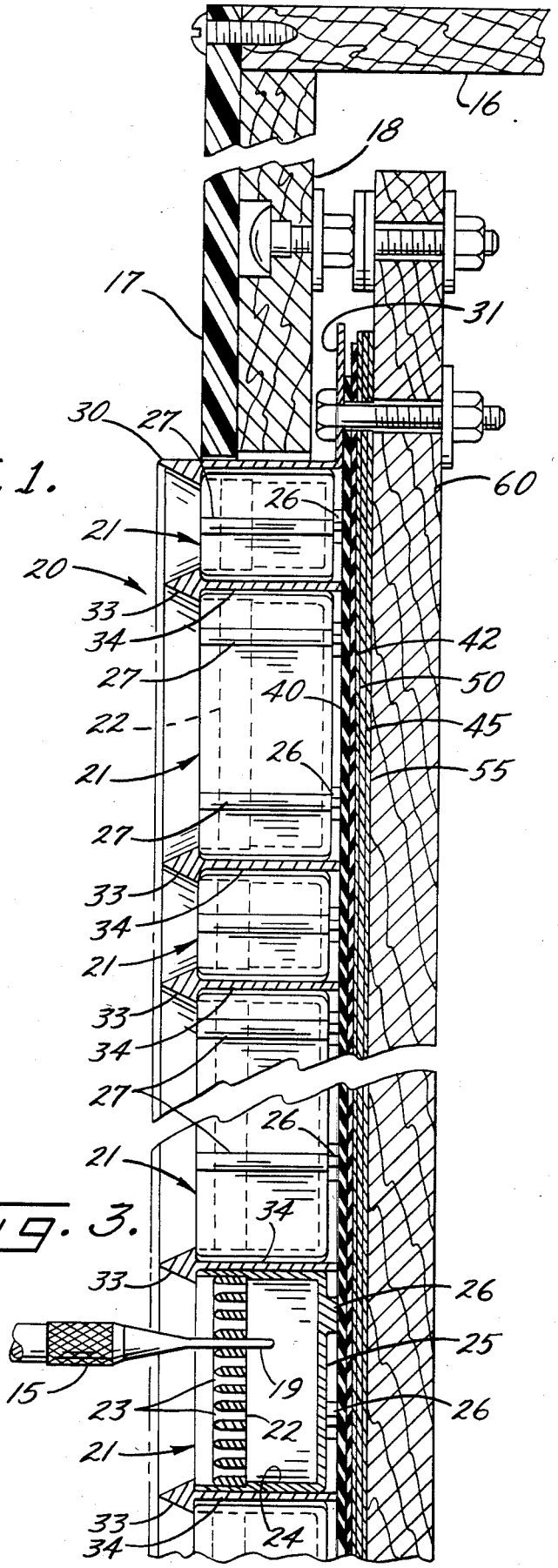
FIG. 3 is an enlarged side elevation of the dart board shown in FIG. 2 taken along line 3—3 in FIG. 2.

Turning now to the drawings, there is shown in FIG. 1 a coin-operated electronic dart game generally designated 14. As is well known, the object of the dart game is for a player to throw darts 15 at a target or dart board 20. For safety purposes, the darts 15 are specially designed with blunt, flexible plastic tips. The dart board 20 is positioned in an upright cabinet 16 such that it protrudes through a large aperture in a plastic plate 17 which is fastened to the cabinet (FIG. 3). The cabinet contains electronic components enabling automatic registration and visual signaling of the score achieved by the players. Since automatic scoring is not new per se and since the electronic components described herein do not form any part of the present invention, further description of such components will be dispensed with.

Figure 4:
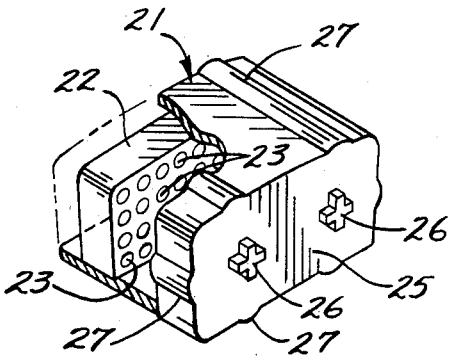
FIG. 4 is a perspective view of one of the target cups used in the dart board of FIG. 2, with parts broken away and shown partially in section.

The dart board 20 is constructed so that a "safe" dart 15 may strike the board and be retained thereon rather than bouncing off the board and falling to the floor. For this purpose, the board 20 consists of numerous hard plastic target sections 21 (FIG. 4) specially designed for reception of "safe" darts 15. Preferably each target section 21 includes a target plate 22 which is formed with a large number of very closely spaced holes 23 for receiving the tip 19 of the dart 15 (FIG. 3). The target plate 22 is supported by a plastic cup 24 (FIG. 4) whose internal peripheral shape corresponds to the peripheral shape of the particular plate. Each cup 24 includes a closed inner end 25 (away from the face of the target 20) and an open outer end (nearest the face of the target 20). The plate 22 is inserted into the open end of the cup 24 and cemented into place. Each cup 24 has a depth of approximately $\frac{7}{8}$ of an inch and each plate 22 is located in its respective cup such that the outer face of the plate is spaced inwardly a short distance from the outer edge of the cup (FIG. 4).

In the present embodiment, the board 20 includes 81 target sections 21 cylindrically arranged and disposed in edge-to-edge relation so as to define different scoring areas. To help define the different scoring areas, the board includes a plastic spider frame 30 having a circular rim 31 (FIGS. 2 and 3) by which the spider is bolted to a rigid support plate 60 located inwardly of the target sections 21. Preferably, the spider 30 includes a series of circumferentially and radially extending ribs 33 which, because of their substantially triangular cross-section (FIG. 3), prevent the target sections 21 from sliding forward out of the spider frame 30 and also deflect thrown darts 15 toward the sections 21. Webbing 34 extends inwardly from each rib 33 and serves as a separator between adjacent target cups. This webbing 34 also serves as a support for the sections 21 so that upon impact from a dart the sections are capable of independent inward motion for closing associated electrical switches for scoring dart hits. Guides 27 in the form of ridges on the sides of the plastic cup 24 (FIG. 4) minimize binding and jamming between the target section 21 and the webbing 34, thereby ensuring ease of inward and outward motion of the cup in the spider frame 30 upon impact of a dart. The guides 27 provide guide means for maintaining the target section 21 in the target frame 30 so that lateral movement of the target section 21 is limited.

Figure 2:
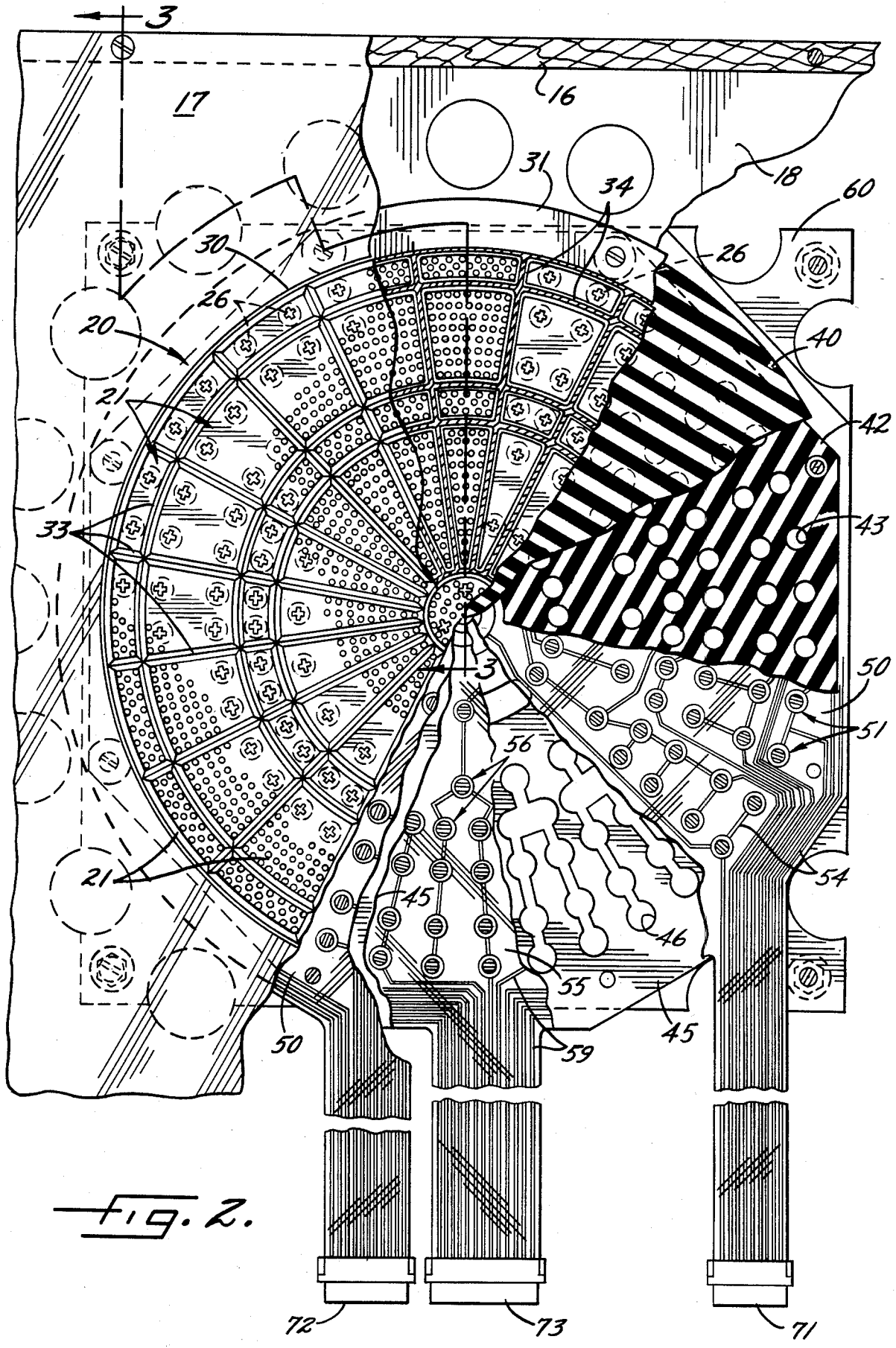
FIG. 2 is an enlarged front elevation of the dart board for the game of FIG. 1 with parts of the board broken away and shown in section.

The target sections 21 are retained in the spider frame 30 by a solid rubber sheet 40 (FIGS. 2 and 3). This sheet 40 abuts the inward side of the circular rim 31 of the spider thereby biasing the target sections in an outward position against the ribs 33 of the spider as shown in FIG. 3. Contact between the target sections 21 and the rubber biasing sheet 40 occurs only at raised feet 26 which protrude from the target sections (FIGS. 4 and 10), thereby creating discrete pressure locations on the rubber sheet when a dart exerts force on a target section. Preferably the biasing sheet 40 and the raised feet 26 are of approximately equal thickness (0.06 inch), which facilitates optimum biasing and resiliency.

Figure 5:
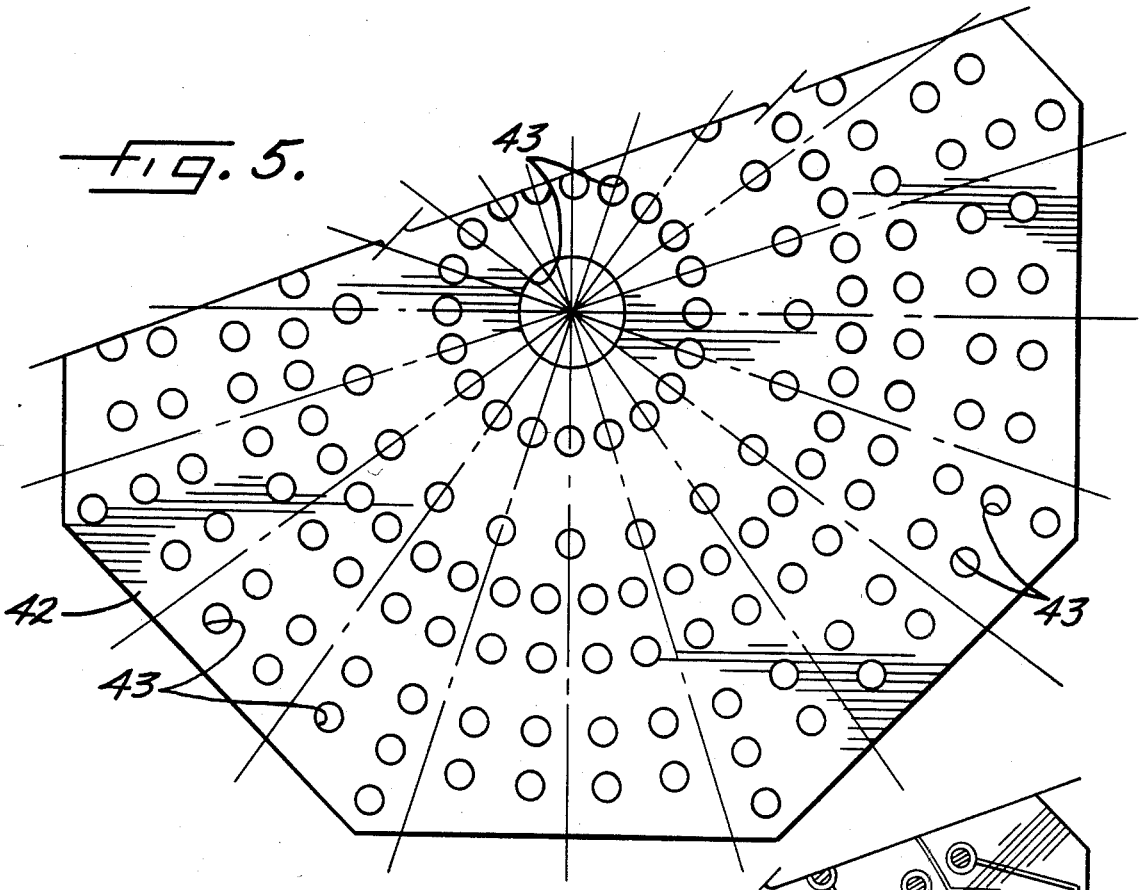
FIG. 5 is a partial plan view of the rubber or Mylar damper used in the dart board of FIG. 2, taken substantially along the line 5—5 of FIG. 10.

Located immediately inward of the solid rubber biasing sheet 40 is a resilient damper 42 (FIGS. 2 and 5). This damper is a sheet of rubber, Mylar or other material, approximately 0.02 inches thick, with a plurality of circular ($\frac{3}{8}$ inch diameter) apertures 43 which, upon proper alignment of the sheet, individually correspond to each of the discrete locations of the target cup raised feet 26.

Figure 6:
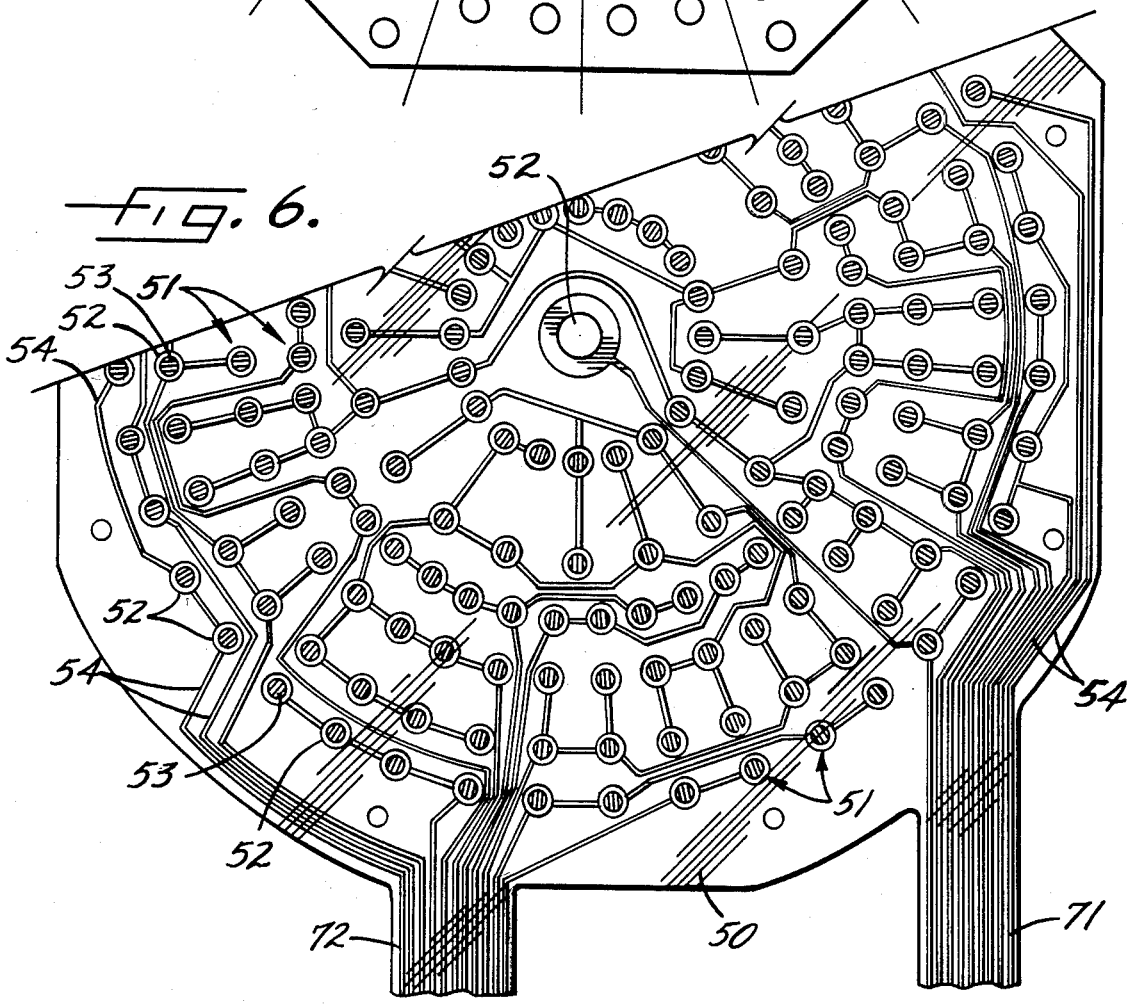
FIG. 6 is a partial plan view of the conductor layer of the switch matrix used in the dart board of FIG. 2, taken substantially along the line 6—6 of FIG. 10.
Figure 7:
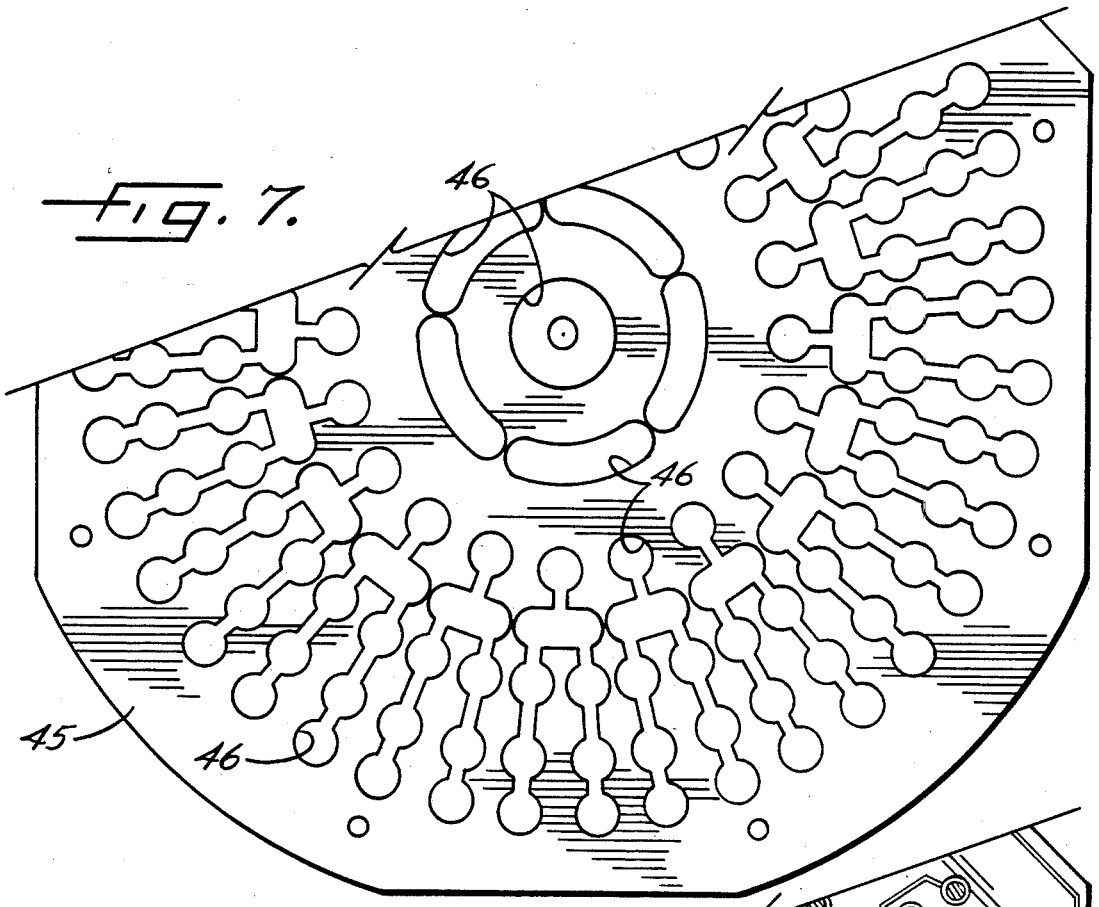
FIG. 7 is a partial plan view of the Mylar spacer used in the dart board of FIG. 2, taken substantially along the line 7—7 of FIG. 10.
Figure 8:
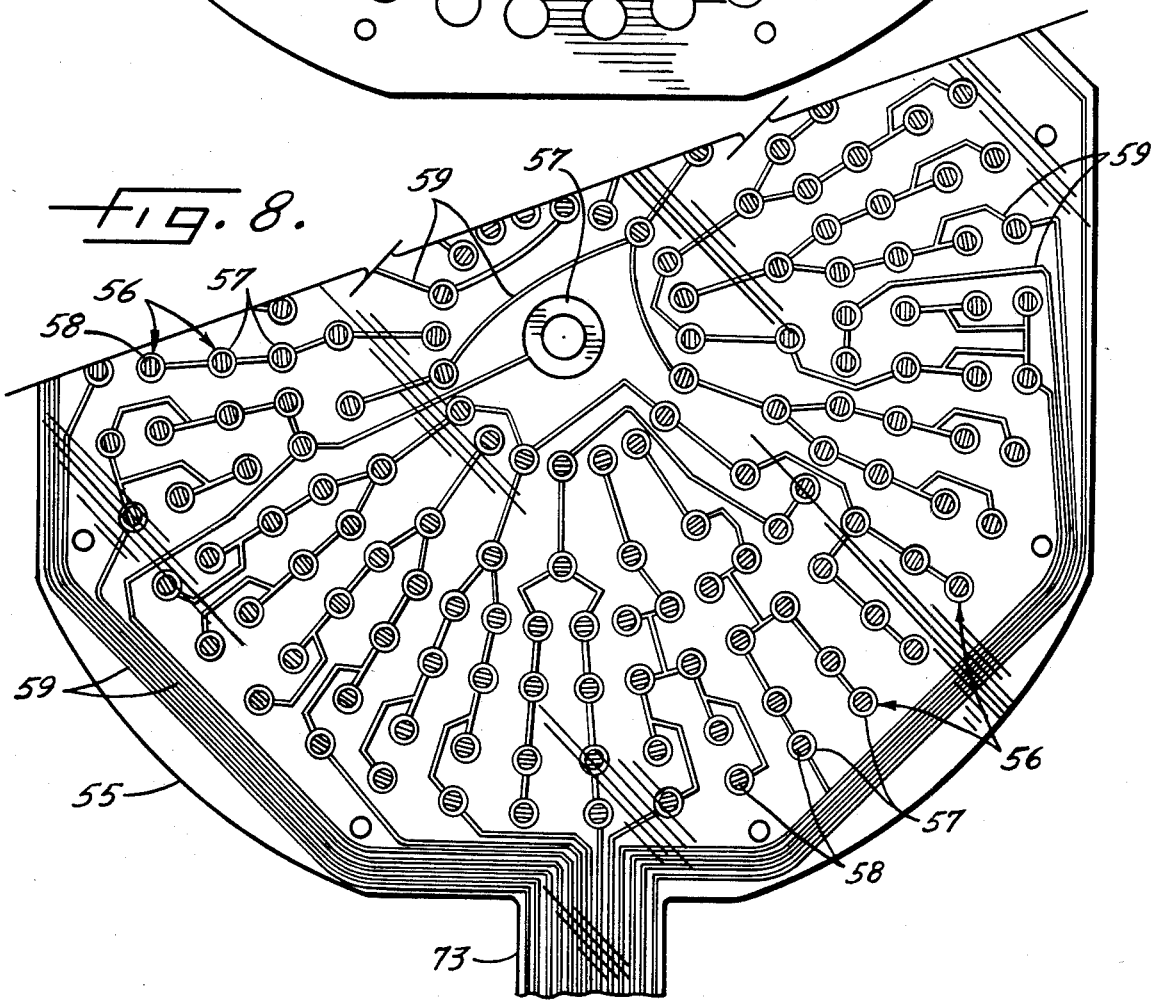
FIG. 8 is a partial plan view of the second conductor layer of the switch matrix used in the dart board of FIG. 2, taken substantially along the line 8—8 of FIG. 10.
Figure 9:
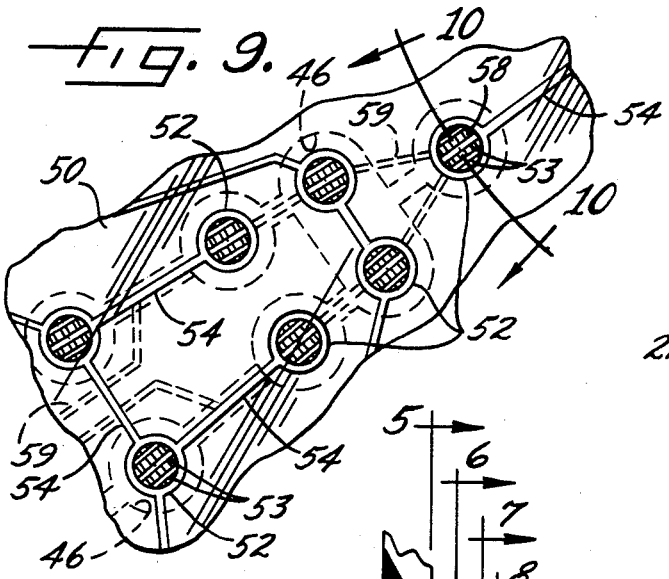
FIG. 9 is an enlarged plan view of the parts shown in FIGS. 6–8.

Located immediately inward of the resilient damper 42 is a pressure sensitive sensor or switch matrix which comprises two silver ink imprinted Mylar sheets 50, 55 (FIGS. 6 and 8, respectively) separated by a nonconducting, apertured Mylar sheet 45 (FIG. 7). As shown in FIGS. 6 and 8, each imprinted Mylar sheet 50, 55 consists of a nonconducting Mylar sheet upon which a silver ink circuit has been imprinted. Each silver ink circuit comprises a series of silver ink switch points 51, 56 interconnected by a series of silver ink lines 54, 59. These lines 54, 59 converge at terminals 71, 72, 73 (FIGS. 2, 6 and 8) whereby the matrix circuits connect to the electronic scorekeeping components of the game. Each switch point 51, 56 comprises a circle of silver ink 52, 57 approximately $\frac{3}{8}$ inch in diameter and three parallel straight lines 53, 58 of silver ink transversing the area defined by the circle (FIGS. 6 and 8). The lines 53 of the first Mylar sheet's switch points 51 are aligned radially to the center of the Mylar sheet 50 (FIG. 6), while the lines 58 of the second Mylar sheet's switch points 56 are aligned tangentially to the center of the Mylar sheet 55 (FIG. 8). The silver ink switch points on the two Mylar sheets 50, 55 are arrayed so that when the sheets are placed adjacent to one another each switch point position on the first sheet 50 corresponds exactly with a switch point position on the second sheet 55 as illustrated in FIG. 9. The apertured Mylar spacer 45 (FIG. 7) is positioned between the two imprinted sheets so that the apertures 46 correspond to the switch point locations on the imprinted sheets as shown in FIG. 9. Accordingly, electrical switches are created at discrete locations because the Mylar sheet 45, which has a thickness of 0.007 inch, separates the two switch matrix halves 50, 55, but the apertures 46 therein allow the switch points 51, 56 to contact one another when force is exerted at the proper discrete locations. The perpendicularity of the switch point lines 53, 58 ensure that electrical contact will be made between the switch halves when compression occurs.

Figure 10:
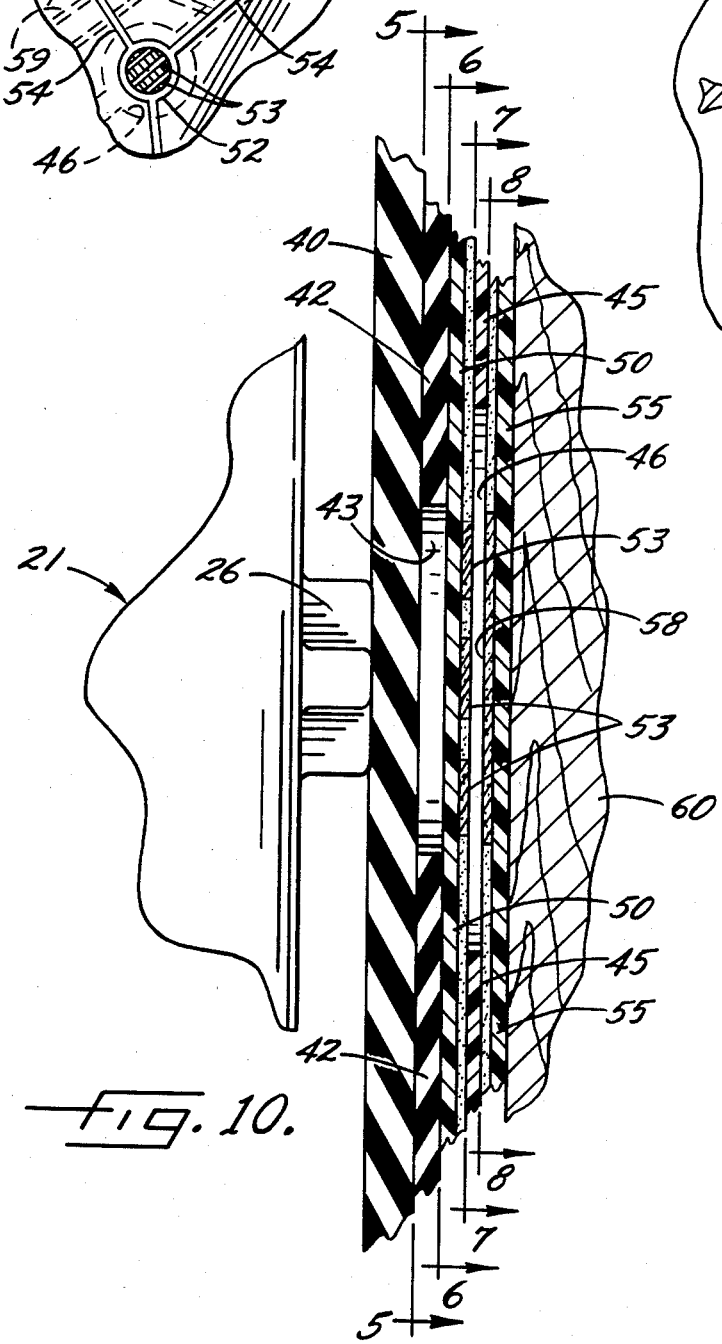
FIG. 10 is an enlarged section of the switch matrix taken substantially along the line 10—10 of FIG. 9 showing a target cup in a relaxed position.
Figure 11:
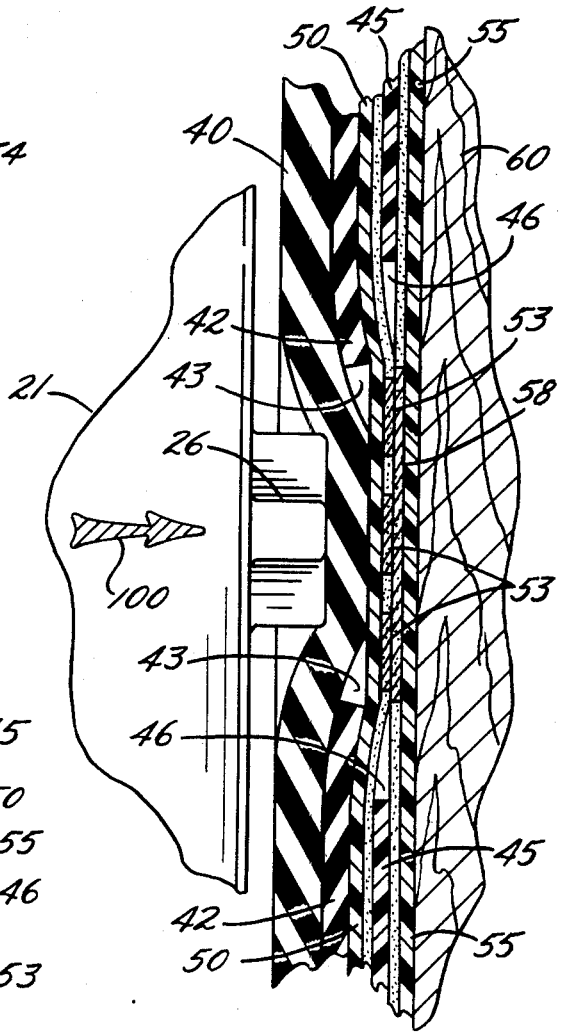
FIG. 11 is a view similar to FIG. 10 but shows a target cup in an activated position.

The locations of these electrical switches, when properly aligned, correspond with the positions of the raised feet 26 of the target sections 21 and the apertures 43 in the damper 42. Referring to FIGS. 10 and 11, the operation of the electronic dart board becomes clear. These figures illustrate the relative position of the various components, in both the relaxed and activated states. In the relaxed position (FIG. 10), the raised foot 26 of the target section 21 rests snugly against the rubber biasing sheet 40, but does not compress this sheet inward at all. Adjacent and directly inward of the biasing sheet is the damper 42. An aperture 43 in this damper 42 lies directly in line with the raised foot 26 of the target section. Immediately behind the damper 42 is the pressure sensitive switch matrix (50, 45 and 55). The silver ink switch point lines 53 of a switch point on the first Mylar sheet 50 and the silver ink switch point lines 58 of a switch point on the second Mylar sheet 55, separated by an aperture 46 in the Mylar spacer 45, lie directly in line with the raised foot 26 of the target section and an aperture 43 in the damper 42. Immediately inward of the switch matrix lies the support plate 60. This is a rigid plate preferably of fiberboard or wood, and is bolted to the spider frame rim 31 so as to secure the aforementioned components in proper relation to one another. This plate is also bolted to the front wall 18 of the upright cabinet 16, thereby maintaining the entire target 20 in its proper place for use (FIG. 3).

From the foregoing, it will be apparent that upon impact from a thrown dart 15 (FIG. 11), the force of the dart's momentum 100 pushes the target section 21 back toward the rigid support plate 60. In so doing, the raised foot 26 of the target section 21 presses discretely on the rubber biasing sheet 40. Being pliable, this rubber sheet deforms and fills the aperture 43 in the damper 42. Upon deforming the full width of this aperture, the rubber sheet contacts the first Mylar sheet 50, which, also being pliable, deforms to fill the aperture 46 in the Mylar spacer 45. Once this narrow aperture (0.007 inches) has been traversed, the silver ink switch point lines 53 of the first Mylar sheet 50 contact the silver ink switch point lines 58 of the second Mylar sheet 55, and an electrical point-indicating signal is produced. The support plate 60, being rigid, does not allow the second Mylar sheet 55 to deform, and therefore ensures that a good contact is made at the switch points. After a moment, the resilient rubber biasing sheet 40 springs back and restores the target section to its original position (FIG. 10), thereby opening the electrical switch point again. Manual resetting of the switch is not required.

This entire process takes only milliseconds, a fact which illustrates the advantage of the apertured Mylar damper 42. In practice, according to known techniques of using matrix switches, a microprocessor scans the switch points on the target 20 at a rate of up to 250–500 times per second. Therefore, the entire target 20 is scanned once every 2–4 milliseconds. Consequently, to ensure that a switch contact is detected, it must have a minimum duration of 4 milliseconds. The apertured damper 42 ensures such contact durations by defining a gap 43. This gap 43 accomplishes the desired objective in two ways. First, it makes the rubber biasing sheet 40 more flexible by allowing it to stretch a greater distance. Consequently, it takes longer for this sheet to rebound to its initial position, and therefore, a switch contact time of increased duration is possible. Without the gap, the solidity of the biasing sheet is such that the target section 21 is snapped back to its initial, relaxed position almost immediately. As a result, the switch contact time may be too short. In other words, the damper 42 is a means for increasing the flexibility of the resilient sheet 40.

Second, this gap 43 defines a distance through which an impacted target section 21 must be displaced before it causes a switch contact to occur. Therefore, a brief time delay results which allows the dart to settle firmly into position in a hole 23 in the target plate 22 before compression of the switch begins. This results in a greater transfer of momentum, thereby ensuring a switch contact of greater duration and continuity.

A further advantage of the gap 43 is that it prevents vibrations of the game cabinet 16 from causing score-indicating switch contacts. Without the damper 42, the solid rubber biasing sheet 40 would directly contact the flexible first sheet 50 of the switch matrix. An external vibration of the cabinet could possibly result in a movement of the rubber sheet sufficient to cause a contact between the opposing switch points. After all, the Mylar spacer 45 creates an aperture 46 between the switch points having a width of only 0.007 inches. When the damper 42 is present, on the other hand, an additional gap of width 0.02 inches is created. Consequently, it is much less likely that an external vibration will cause a score-indicating switch contact.

An effect similar to an external vibration is the vibration caused by "crossed" darts. A crossed dart problem involves a second thrown dart striking a first dart already received and held by a target section 21. In such a situation, the first dart already received may wiggle and register a score or hit even through the second dart may strike a different target section and also register a score. The wiggling first dart, in other words, causes a vibration not unlike an external vibration to the cabinet 16. The gap 43 helps eliminate the crossed dart problem by preventing the wiggling first dart from registering a score.

Still another advantage of the gap 43 is that the movement of the target sections 21 permitted by the gap helps dislodge foreign particles which might jam the cups, preventing them from moving upon dart impact to score dart hits, or which might jam a switch contact on the switch matrix 45, 50, 55 to a permanently closed state.

A final advantage of the gap 43 is that the gap 43 permits the use of a support plate 60 that is not precisely flat. The deviation, tolerance or warpage of the support plate 60 needs to be small only in relation to the extent of the gap 43.

In practical terms, the combination of the damper 42 having apertures aligned with the target sections 21, the ridges 27 on the target sections, and the dimensions and orientation of the biasing sheet 40 and switch matrix 45, 50, 55 provide the electronic dart game 14 with a highly reliable means for automatically detecting and registering the scores of players.

What is claimed is:

1. A target for use in an electronic game with automatic scorekeeping capability having a front side to which projectiles are projected and an inner side, said target comprising:

a plurality of target sections for receiving said projectiles;

a target frame, in which said target sections are slidable inwardly and outwardly, and which holds said target sections in a predetermined array;

a pressure sensitive sensor matrix, located inward of said target frame, having first and second conductive contact layers separated by a non-conductive middle layer, said first conductive contact layer being pliable, said first and second contact layers having opposed pairs of contact points aligned with respective ones of said target sections, and said non-conductive middle layer having apertures through which the contact points in said first contact layer are movable in response to pressure from aligned target sections to contact their respective opposed contact points to produce respective electrical contact-point indicating signals;

dampening means, located between said target frame and said pressure sensitive sensor matrix, wherein said dampening means comprises a sheet of material having apertures aligned with said target sections so that a distance is defined through which each target section must be inwardly displaced in response to the impact of said projectile in order to push against said sensor matrix and transmit, thereby, an impulse to said pressure sensitive sensor matrix.

2. A combination as claimed in claim 1 in which each target section has an outer end formed so as to be receptive to said projectile, and an inner end;

guides means, in the form of external ridges, for maintaining said target section in said target frame so that lateral movement of said target section is limited; and at least two raised feet protruding from the inner end.

3. A combination as claimed in claim 2 in which said raised feet are cross-shaped.

4. A combination as claimed in claim 1 in which said dampening means comprises means for delaying the transfer of momentum from each target section to said pressure sensitive sensor matrix, thereby ensuring electrical contact-point indicating signals of enhanced continuity and duration.

5. A combination as claimed in claim 1 in which said dampening means comprises means for preventing vibrations of said electronic game from creating electrical contact-point indicating signals.

6. A combination as claimed in claim 1 in which said dampening means includes a resilient sheet for biasing said target sections in the outward position in said target frame.

7. A combination as claimed in claim 6 in which said dampening means comprises means for increasing the flexibility of said resilient sheet, thereby delaying its spring back time and increasing the duration of the electrical contact-point indicating signals.

8. A target board for use in an electronic game with automatic scorekeeping capability having a front side to which projectiles are projected and an inner side, said target board comprising:

a plurality of target sections for receiving said projectiles;

a target frame in which said target sections are slidable inwardly and outwardly, which holds said target sections in a predetermined array;

a pressure sensitive switch matrix, located inward of said target frame, having switches individually responsive to pressure from aligned target sections, contact and closure of said switches indicating a predetermined score, wherein said switch matrix comprises first and second conductive contact layers separated by a non-conductive middle layer, said first conductive contact layer being pliable, said first and second contact layers having opposed pairs of switch points of said switches aligned with respective ones of said target sections, and said non-conductive middle layer having apertures through which the switch points in said first contact layer are moveable in response to pressure from aligned target sections to contact their respective opposed switch points to produce said closure of said switches;

delay means, located between said target frame and said pressure sensitive switch matrix, comprising a sheet of material having apertures aligned with said target sections, so that a distance is defined through which the target section receiving one of said projectiles must be inwardly displaced by the impact of said projectile in order to push against the respective switch and transmit, thereby, an impulse to said pressure sensitive switch matrix;

biasing means, located between said target frame and said delay means, for biasing said target sections in the outward position in said target frame, and for increasing the duration of said transmission of momentum by padding the impact point between the target sections and said pressure sensitive switch matrix.

9. A combination as claimed in claim 8 in which each target section has an outer end formed so as to be receptive to said projectile, and an inner end;

guides means, in the form of external ridges, for maintaining said target section in said target frame so that lateral movement of said target section is limited by said ridges; and at least two raised feet protruding from the inner end.

10. A combination as claimed in claim 9 in which said raised feet are cross-shaped.

11. A combination as claimed in claim 8 in which said delay means comprises means for delaying the transfer of momentum from said target section to said pressure sensitive switch matrix, thereby ensuring switch contact of enhanced continuity and duration.

12. A combination as claimed in claim 8 in which said delay means comprises a means for preventing vibrations of said electronic game from creating a score-indicating switch connection.

13. A combination as claimed in claim 8 in which said delay means comprises means for increasing the flexibility of said biasing means, thereby delaying its spring back time and increasing the duration of switch contacts.

14. A dart board for use in an electronic game with automatic scorekeeping capability having a front side which forms a target for "safe" darts with flexible tips an inner side, said board comprising:

a plurality of target sections for receiving and holding the tip of a dart, the target sections having feet which protrude inwardly;

a spider target frame in which said target sections are slideable inwardly and outwardly, which holds said target sections in a predetermined array;

a resilient sheet, located inward of said spider target frame, said sheet biasing said target sections in the outward position in said spider target frame;

a pressure sensitive switch matrix, located inward of said resilient sheet, having switches aligned with said feet of said target sections and responsive to contact therefrom, such contact indicating a predetermined score, wherein said switch matrix comprises first and second conductive contact layers separated by a non-conductive middle layer, said first conductive contact layer being pliable, said first and second contact layers having opposed pairs of switch points of said switches aligned with respective ones of said target sections, and said non-conductive middle layer having apertures through which the switch points in said first contact layer are moveable in response to pressure from aligned target sections to contact their respective opposed switch points to produce said closure of said switches; and a damper sheet, located between said resilient sheet and said pressure sensitive switch matrix, having apertures aligned with said feet of said target sections, so that a distance is defined through which an impacted one of said target sections must be inwardly displaced upon receiving one of said darts in order to push against the respective one of said switches and transmit, therby, an impulse to said pressure sensitive switch matrix.

15. A combination as claimed in claim 14 in which each said target section has an open front-facing end receiving a target plate, and a closed inner end; and guides in the form of external ridges for maintaining said target section in said spider target frame so that lateral movement of said target section is limited by said ridges.

16. A combination as claimed in claim 15 in which said feet are cross-shaped.

17. A combination as claimed in claim 14 in which said conducting sheets comprise nonconducting sheets imprinted with conducting ink so as to create a printed circuit for conducting switch points aligned with said feet of said target sections;

and wherein said switch matrix further comprises a support plate of nonpliable material, located inward of said second conducting sheet and bolted to said spider target frame such that when the impact of said dart pushes said target section inward said first conducting sheet is deformed at discrete locations between said feet and said support plate, thereby creating an electrical connection.

18. A combination as claimed in claim 14 in which said damper creates a gap between said feet and said pressure sensitive switch matrix having a width in the range of 0.015 inches to 0.025 inches, said gap thereby delaying the transfer of momentum from said feet of the impacted target section to said switch until said dart is firmly implanted in said target section and ensuring a switch contact of enhanced continuity and duration.

19. A combination as claimed in claim 14 in which said damper creates a gap between said feet and said pressure sensitive switch matrix having a width in the range of 0.015 inches to 0.025 inches, said gap thereby preventing vibrations from creating a score-indicating switch connection.

20. A combination as claimed in claim 14 in which said damper increases the flexibility of said resilient sheet, said increased flexibility delaying the spring back time of said resilient sheet and increasing the duration of the switch contact.

* * * * *